United States Patent [19]

Matsuo et al.

[11] Patent Number: 5,063,719

[45] Date of Patent: Nov. 12, 1991

[54] COLUMN BASE STRUCTURE

[75] Inventors: Hideshige Matsuo; Isamu Yamamoto; Osamu Narishige; Michio Itoh, all of Kitakyushu; Kuniaki Sato, Hiratsuka; Yoshihiro Nakamura, Tama; Akio Tomita, Tokyo; Toshikazu Yamada, Akishima; Yoshikazu Maeda, Tokyo, all of Japan

[73] Assignee: Hitachi Metals, Ltd., Tokyo, Japan

[21] Appl. No.: 282,372

[22] Filed: Dec. 9, 1988

[30] Foreign Application Priority Data

| | | | |
|---|---|---|---|
| Sep. 7, 1988 | [JP] | Japan | 63-223877 |
| Sep. 7, 1988 | [JP] | Japan | 63-223878 |
| Oct. 21, 1988 | [JP] | Japan | 63-265674 |

[51] Int. Cl.[5] ..... E02D 27/00

[52] U.S. Cl. ..... 52/296; 52/295

[58] Field of Search ..... 52/296, 297, 295, 294, 52/292; 248/357, 188.9

[56] References Cited

U.S. PATENT DOCUMENTS

| | | | |
|---|---|---|---|
| 1,409,089 | 3/1922 | Fitch | 52/296 |
| 1,761,507 | 6/1930 | Williams | 52/296 |
| 1,761,508 | 6/1930 | Williams | 52/296 |
| 1,937,964 | 12/1933 | Jenner | 52/295 |
| 4,048,776 | 9/1977 | Sato | 52/297 |
| 4,070,837 | 1/1978 | Sato | 52/297 |
| 4,136,811 | 1/1979 | Sato | 52/296 |

FOREIGN PATENT DOCUMENTS

| | | |
|---|---|---|
| 804813 | 2/1981 | U.S.S.R. . |
| 1133357 | 1/1985 | U.S.S.R. . |

OTHER PUBLICATIONS

Engineering News: Nov. 28, 1912, p. 991.

*Primary Examiner*—Michael Safavi
*Attorney, Agent, or Firm*—McGlew & Tuttle

[57] ABSTRACT

A column base structure having connected a pair of column-base metal fittings to the lower part of a column consisting of a pair of main column members disposed at predetermined intervals and connecting members disposed in such a manner as to integrally connect the main column members; the column base metal fittings being fixedly fitted to a concrete foundation via anchor bolts and nuts; characterized in that a horizontal member having a predetermined cross-sectional area is integrally and fixedly fitted between the main column members in the vicinity of the column base metal fitting.

5 Claims, 8 Drawing Sheets

COLUMN BASE STRUCTURE

BACKGROUND OF THE INVENTION

This invention relates generally to a column base structure for steel-frame structures, and more particularly to a column base structure using a steel-frame column formed in such a fashion that the outside cross-sectional dimensions thereof in the direction of the major-axis intersecting orthogonally with the minor axis is made larger than the outside cross-sectional dimensions thereof in the minor-axis direction.

DESCRIPTION OF THE PRIOR ART

The most commonly used method of erecting a steel-frame column on a concrete foundation, is to secure in place a column base metal fitting, which has been fabricated by steel plates and integrally joined to the column base of the steel-frame column by welding or bolts and nuts, via anchor bolts embedded into the concrete foundation. FIGS. 1 and 2 are a partially cross-sectional front view and a partially cross-sectional plan view, respectively, of a column base structure mentioned above. In both figures, a steel-frame column 1 is formed by disposing a pair of main column members 11, made of H-section steel, for example, at predetermined intervals (approximately 300–2,000 mm) with the webs thereof arranged in parallel and welding together the main column members 11 and 11 via a connecting member 12, which is made of a steel pipe and disposed in an inclined fashion with respect to the floor surface. Numeral 2 indicates a column base metal fitting, formed by disposing an upper steel plate 21 and a lower steel plate 22, both formed into a rectanglular planar sectional shape, and integrally connecting the upper and lower steel plates 21 and 22 via a plurality of connecting members 23, made of steel plates. The steel-frame column 1 and the column base metal fitting 2, both fabricated in the aforementioned manner, are joined together by welding, and placed on a precast concrete foundation 3 using partial mortar 4. In doing so, the column base metal fitting 2 is positioned by means of bolt holes (not shown) drilled on the column base metal fitting 2 corresponding to a predetermined number of anchor bolts 5 embedded in the concrete foundation 3. Mortar 6 is then poured between the column base metal fitting 2 and the concrete foundation 3, and after the mortar 6 has been sufficiently cured, the steel-frame column 1 is secured in place using anchor bolts 5 and nuts 8 via washers 7.

With the abovementioned construction of the column base structure, the upper and lower steel plates 21 and 22 having large outside dimensions, and a large number of the connecting members 23 connecting both are required because the anchor bolts 5 must be disposed outside the projected contour of the steel-frame column 1. This makes it necessary to increase the floor space for the column base metal fitting 2 and the weight of the column base metal fitting 2, leading to increased manhours and extremely complex handling and transportation. Furthermore, sufficient strength must be imparted to the joints between the steel-frame column 1 and the column base metal fitting 2 and the joints between the component members of the column base metal fitting 2 so as to withstand the bending moment and shearing force exerted onto the steel-frame column 1. To this end, grooves have to be provided on the joints, and the joints are butt welded using backing strips. This involves increased manhours for fabricating the column base and extremely complicated welding operations, resulting in increased cost.

As a means to solve the above problems, there can be a column base structure where independent column base metal fittings, made of cast steel, for example, are joined to the lower ends of the main column members 11 and 11 of the steel-frame column 1. With this arrangement, welding operations for fabricating the column base can be facilitated, and the floor space for the column base metal fittings can be reduced.

FIG. 3 is a longitudinal section of the essential part of a column base structure having the above construction. In the figure, a column base metal fitting 2 is integrally joined to a steel-frame column 1 by welding, and placed on a precast concrete foundation 3 via partial mortar 4. In doing so, the column base metal fitting 2 is positioned using bolt holes 9 drilled on the column base metal fitting 2 corresponding to a predetermined number of anchor bolts 5 embedded in the concrete foundation 3. Mortar 6 is then poured between the column base metal fitting 2 and the concrete foundation 3, and after the mortar 6 has been sufficiently cured, the steel-frame column 1 is secured in place using anchor bolts 5 and nuts 8 via washers 7. The anchor bolts 5 can be embedded into the concrete foundation 3 with high precision by erecting a steel frame 13 on a concrete subslab 10 and a base plate 14. In this case, a sleeve 15, as a means to improve the rotational rigidity of the column base, can be provided on the shank part **5*a* of the anchor bolt 5 to prevent the anchor bolt 5 and the concrete foundation 3 from sticking together and to impart a tension force to the anchor bolt 5 by tightening the nut 8**.

The column base structure of the above construction is effective in that welding operations can be facilitated and the floor space for the column base metal fitting can be reduced, but it has a disadvantage in that the required performance for a column base cannot be satisfactorily ensured merely by joining an independent column base metal fitting 2 (see FIG. 3) to the lower end of a main column member 11 constituting a steel-frame column 1 as shown in FIG. 1.

FIG. 4 is a front view of the essential part illustrating the state of external forces exerted onto the column base structure having the above construction. Like parts are indicated by like reference numerals shown in FIGS. 1 and 2. In FIG. 4, numeral 2 refers to a column base metal fitting, made of cast steel, for example, and having integrally formed a projection **2*a*, corresponding to the lower end face of the main column member 11, and a base part 2*b*. The steel-frame column I and the column base metal fitting 2** are joined together by welding.

In an earthquake or storm, a bending moment M and a shearing force Q are generated in the column base structure having the above construction. If the bending moment M acts in the direction shown by an arrow shown in the figure, a tensile force T is generated in the left-hand main column member **11*a* while a compressive force N in the right-hand main column member 11*b*. In this case, the main column member 11*b*, to which the compressive force N is exerted, can withstand the shearing force Q because of the presence of a frictional force F produced between the column base metal fitting 2 and the concrete foundation 3. The main column member 11*a*, to which the tensile force T is exerted, on the other hand, cannot withstand the shearing force Q because a frictional force between the column base metal fitting 2 and the concrete foundation 3** is reduced, producing a gap as shown in FIG. 4 in extreme cases. As a result, the shearing force Q has to be countervailed only by the frictional force F produced between the column base metal fitting 2 joined to the main column member 11*b*, to which the compressive force N is exerted, and the concrete foundation 3. This could cause a deformation, or a buckling at the lower end of the main column member 11*b*, as shown in FIG. 4. To prevent this deformation or buckling, the rigidity or outside dimensions of the main column members 11*a* and 11*b* must be increased to an unwanted degree.

The above problems arise not only in a steel-frame column 1 of a so-called lattice structure where the main column members 11*a* and 11*b* are connected by the connecting members 12, but also in a column consisting of a pair of flange members formed in a strip shape and disposed at predetermined intervals and web members having a flatplate shape and disposed so as to integrally connect the flange members and formed into an I or H shape in cross section. That is, if an interval between a pair the flange members, or the width of the web members is large enough, any of the web members constituting the column may deform or buckle as a shearing force generated in the column base, to which a compressive force is exerted, is transmitted to the column base, to which a tensile force is exerted. Consequently, the column having such a construction cannot withstand the shearing force exerted to the column base thereof.

In a column base structure in which anchor bolts 5 are embedded into a concrete foundation 3 with the shank part 5*a* thereof embedded in an axially unrestricted state, and a column base metal fitting 2 having a large rigidity is employed, the rotational rigidity of the column base thereof, that is, the strength of a rotational reacting force against the bending moment generated in the column base, is determined by the extensional rigidity of the entire anchor bolt 5. Meanwhile, the anchor bolt 5 is usually manufactured by providing threads on both ends of a round steel bar having an equal diameter by means of a machine tool, such as a lathe, or thread chasing machine, or manually using a die. The threads of an anchor bolt are therefore such that the minor diameter di of the threaded part 5*b* is made smaller than (about 75% of) the outside diameter d of the shank part 5*a*, as shown in FIG. 5. For this reason, when a bending moment is generated in the column base, and a tensile load is exerted onto the anchor bolt 5, the stress on the threaded part 5*b* naturally becomes larger than the stress on the shank part 5*a*. This causes the threaded part 5*b* to reach the yield point, leading to an extreme elongation of the threaded part 5*b*. As a result, while an anchor bolt 5 made of steel has a Young's modulus of approx. $2.1\times10^3$ t/cm$^2$ and an apparently large extensional rigidity, the entire anchor bolt 5, including the threaded part 5*b*, has a lower Young's modulus of $1.0\times10^3$ t/cm$^2$, or about half as much extensional rigidity. If the rotational rigidity of the column base is lowered, as noted above, the above, the aseismicity and safety of the column base when exposed to a horizontal load in an earthquake or storm would be deteriorated. Increasing the diameter of the entire anchor bolts 5 would unnecessarily increase the outside diameter of the shank part 5*a*. This would lead not only to uneconomy but also to the increased weight of the entire anchor bolt 5 and therefore to troublesome handling and/or transportation.

In the conventional column base structure, as mortar 6 is poured into the gap between the column base metal fitting 2 and the concrete foundation 3 after the column base metal fitting 2 has been placed on the partial mortar 4, as shown in FIG. 1, a cavity may be produced due to the air entrapped, resulting in poor adhesion of the mortar 6 to the entire bottom surface of the column base 2.

FIG. 6 is a diagram of assistance in explaining the flow of the mortar 6 in a form 16. In FIG. 6, shown by a chain line is an outside contour of the column base metal fitting 2. The partial mortar 4 is usually formed into a quadrilateral planar shape, as shown in the figure. As the mortar 6 is poured from a container, such as a hopper, in the direction shown by arrow A in a state shown by FIG. 6, the mortar 6 flows along the flow lines shown by arrow B. But the flow of the mortar 6 is divided by the partial mortar 4, and then joined together again on the downstream side. During this process, the air existing between the column base 2 and the concrete foundation 3 is entrapped, forming a cavity 17, as shown by a shaded portion in the figure.

The required performance for a column base structure includes adhesion between the mortar and the column base metal fitting, in addition to the rigidity of the column base metal fitting and the fastening strength of the anchor bolts. The presence of a cavity 17 on the bottom surface of the column base structure 2, as noted above, could cause deterioration in the performance of the column base structure, leading to a sharp decrease in aseismicity.

SUMMARY OF THE INVENTION

It is the first object of this invention to provide a column base structure having good aseismicity and a rotational rigidity enough to countervail against the bending moment and shearing force exerted to the column base.

It is the second object of this invention to provide a column base structure that can reduce the floor space for the column base and increase the building space.

It is the third object of this invention to provide a column base structure that involves extremely easy welding operations of the column base, reduced manhours and low manufacturing cost.

DETAILED DESCRIPTION OF PREFERRED EMBODIMENTS

Figure 1:
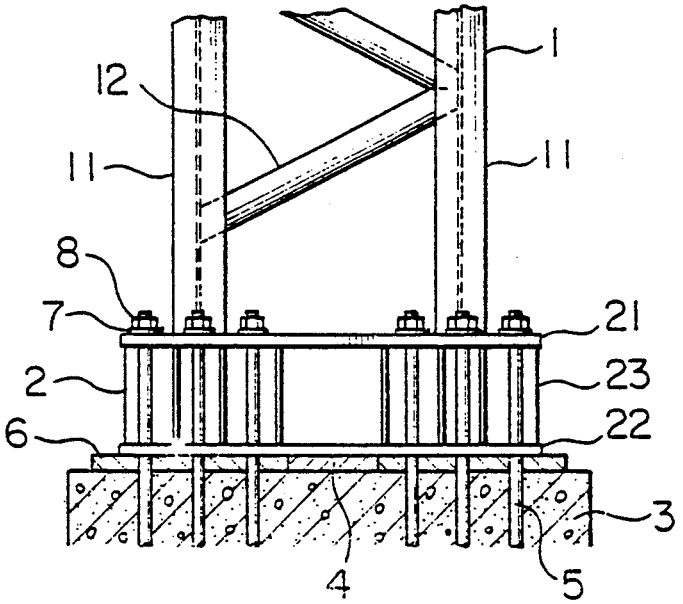
FIG. 1 (PRIOR ART)
FIGS. 1 and 2 are a partially cross-sectional front view and a partially cross-sectional plan view, respectively, of a column base structure of a conventional type.
Figure 2:
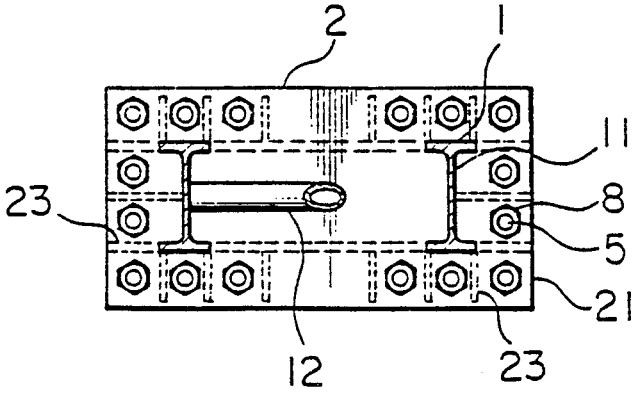
FIG. 2 (PRIOR ART)
Figure 4:
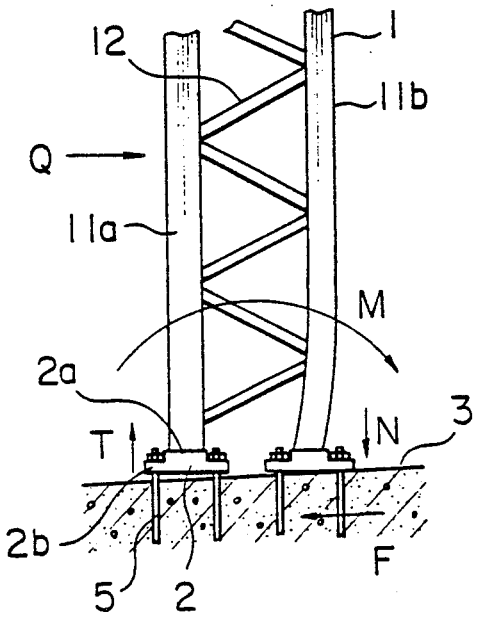
FIG. 4 (PRIOR ART)
FIG. 4 is a front view of the essential part illustrating the state where external forces are exerted to a conventional column base structure.
Figure 7:
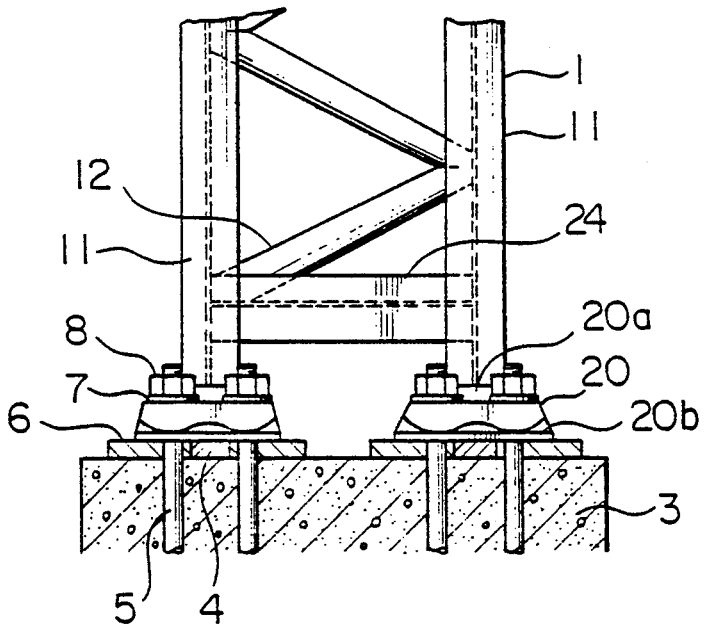
FIGS. 7 and 8 are a partially cross-sectional front view and a partially cross-sectional plan view, respectively, of a first embodiment of this invention.
Figure 8:
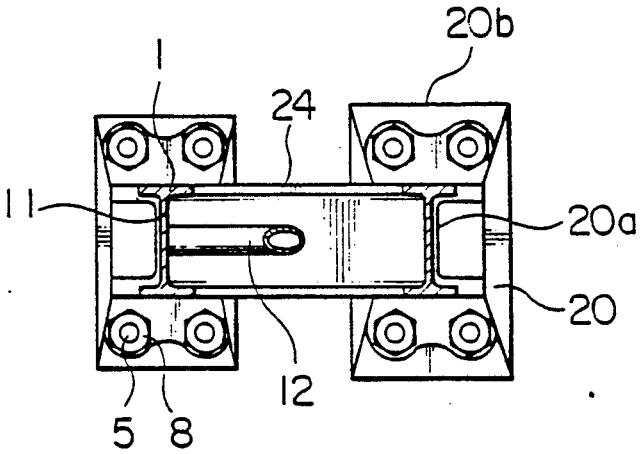

FIGS. 7 and 8 are a partially cross-sectional front view and a partially cross-sectional plan view of a first embodiment of this invention. Like parts are indicated by like reference numerals shown in FIGS. 1, 2 and 4. In FIGS. 7 and 8, numeral 24 refers to a horizontal member, which is formed by H-section steel, for example, of the same outside dimensions as those of the main column member 11, disposed in parallel with the floor surface between the main column members 11 and 11 in the vicinity of the lower end of the main column member 11; both ends thereof being integrally joined by welding to the main column member 11. The column base metal fitting 20 is fixedly fitted to the lower end of the main column member 11 via a projection 20*a*.

With the above construction, a shearing force generated in a main column member 11, to which a compressive force is exerted, can be transmitted to another main column member 11, to which a tensile force is exerted via the horizontal member 24. In this case, to ensure smooth and positive transmission of the shearing force, the cross-sectional area A of the horizontal member 24 must be determined so that the following relationship holds for the cross sectional area $A_o$ and yield point $\sigma_{65\,o}$ of the main column member 11, and the cross-sectional area A and yield point $\sigma_\gamma$ of the horizontal member 24.

$$A \geqq 0.1 \frac{\sigma_{\gamma o}}{\sigma_\gamma} A_o$$

The above equation will be described in the following. In this invention, the horizontal member may be such that the shearing force Q exerted to the main column member to which a compressive force is applied is transmitted to another main column member. To have a column base with a good performance in any case, however, the cross-sectional area of the horizontal member must be maintained so that the maximum shearing force $Q_{max}$ considered to be exerted to the main column member, to which a compressive force is applied, can be transmitted to another main column member.

Figure 9:
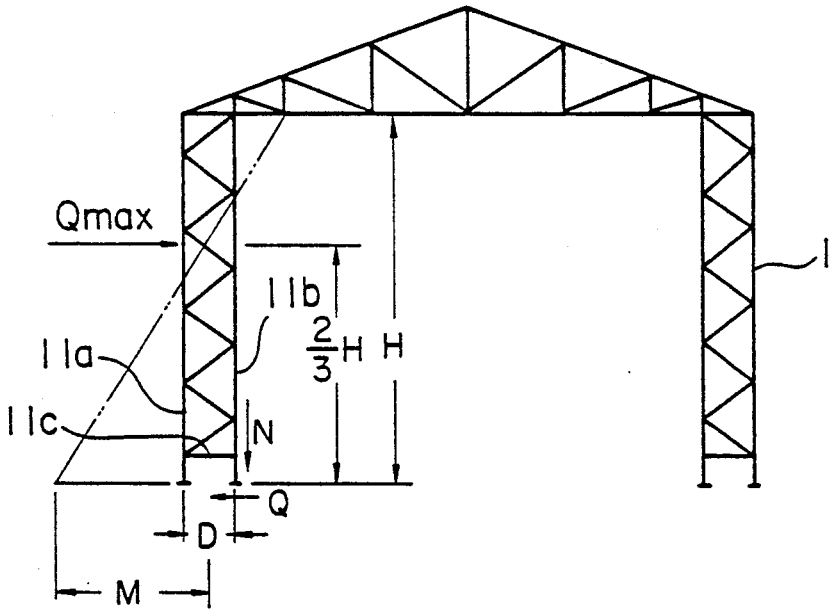
FIG. 9 is a diagram of assistance in explaining external forces exerted to a building with which this invention is concerned.

FIG. 9 is a diagram of assistance in explaining external forces exerted to a building with which this invention is concerned. In FIG. 9, assuming a shearing force exerted to a steel-frame column 1 in an earthquake is $Q_{max}$ and the height of the steel-frame column 1 is H, a bending moment M exerted to the column base is expressed by Equation (1).

$$M = Q_{max} \times \tfrac{2}{3} H \tag{1}$$

Consequently, assuming the distance between the main column members 11*a* and 11*b* is D, an axial force N as expressed by Equation (2) below is exerted to the main column member 11*b* to which a compressive force is applied.

$$N = \frac{M}{D} \tag{2}$$

If all the shearing forces exerted to the steel-frame column 1 are borne by the main column member 11*b* to which a compressive force is exerted, the shearing force Q applied to the main column member 11*b* is expressed by Equation (3).

$$Q = Q_{max} \tag{3}$$

Now, the relationship between the height H of the steel-frame column 1 and the distance D between the main column members 11*a* and 11*b* is generally expressed by Equation (4).

$$\frac{H}{D} \leqq 15 \tag{4}$$

Consequently, introducing Equations (1) and (4) into Equation (2) yields Equation (5).

$$N \leqq \frac{\frac{2}{3} Q\max H}{\frac{H}{15}} \leqq 10\, Q\max \tag{5}$$

That is, the relationship between the maximum shearing force $Q_{max}$ exerted to the main column member 11*b* to which a compressive force is applied and the axial force N can be expressed by Equation (6).

$$\frac{Q\max}{N} \geqq 0.1 \tag{6}$$

Next, the cross-sectional area $A_o$ of the main column member 11*b* to which a compressive force is applied, the cross-sectional area of the horizontal member 11*c*, the yield point $\sigma_{\gamma o}$ of the main column member 11*b* and the yield point $\sigma_\gamma$ of the horizontal member are in a relationship expressed by Equations (7) and (8).

$$A = \frac{Q\max}{\sigma_y} \tag{7}$$

$$A_0 = \frac{N}{\sigma_{y0}} \tag{8}$$

From Equations (7) and (8), Equation (9) is obtained.

$$A = \frac{Q\max}{N} \cdot \frac{\sigma_{y0}}{\sigma_y} \cdot A_0 \tag{9}$$

Introducing Equation (6) into Equation (9) yields Equation (10).

$$A \geqq 0.1 \frac{\sigma_{y0}}{\sigma_y} A_0 \quad (10)$$

With the above construction, in which independent column base metal fittings 20 and 20 are fixedly fitted to the main column members 11 and 11, the deformation or buckling of the main column member 11 due to shearing and compressive forces can be prevented since a pair of the main column members 11 and 11 can withstand the shearing force.

Figure 10:
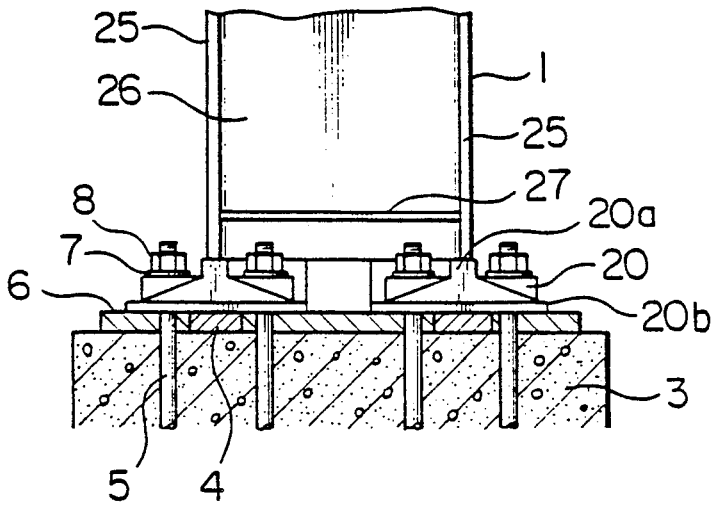
FIGS. 10 and 11 are a partially cross-sectional front view and a partially cross-sectional plan view, respectively, of a second embodiment of this invention.
Figure 11:
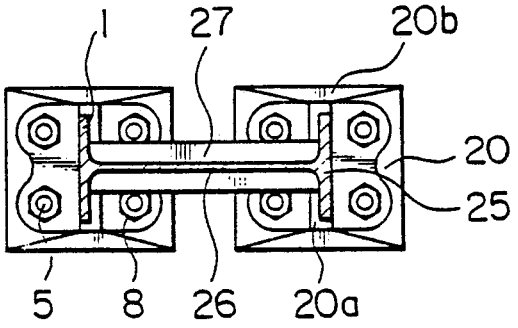

FIGS. 10 and 11 are a partially cross-sectional front view and a partially cross-sectional plan view, respectively, of a second embodiment of this invention. Like parts are indicated by like numerals shown in FIGS. 1, 2 and 4. In FIGS. 10 and 11, a steel-frame column 1 is formed by welding steel plates into an I or H cross-sectional shape. That is, a steel-frame column 1 is formed by a pair of the flange members 25 and 25 formed into a strip shape and disposed at a predetermined intervals, and a web member 26 formed into a flat-plate shape and disposed in such a manner as to integrally connect the flange members 25 and 25. In the neighborhood of the lower end of the steel-frame column 1, a horizontal member 27 made of a steel strip is provided and disposed in parallel with the floor surface. The horizontal member 27 is integrally joined by welding to the flange members 25 and 25 and the web member 26. In this case, too, the cross-sectional area A of the horizontal member 27 must be determined so that the following relationship holds, as in the previous embodiment.

$$A \geqq 0.1 \frac{\sigma_{y1}}{\sigma_y} A_1$$

where $A_1$ is the cross-sectional area of the flange member 25 on a cross section at which the flange member 25 intersects orthogonally with the axial line of the steel-frame column 1, and $\sigma_{y1}$ is the yield point of the flange member 25.

With the above construction, the shearing force generated in the flange member 25, to which a compressive force is applied, can be transmitted via the horizontal member 27 to another flange member 25, to which a tensile force is applied. However the above forces are also exerted to the web member 26, and such forces may cause the deformation or buckling of the web member 26 in a column base structure having the web member 26 of a large width, the web member 26 can be reinforced by a horizontal member 27 disposed in the vicinity of the lower end of the steel-frame column 1. Other effects are similar to the embodiment shown in FIGS. 7 and 8.

Figure 5:
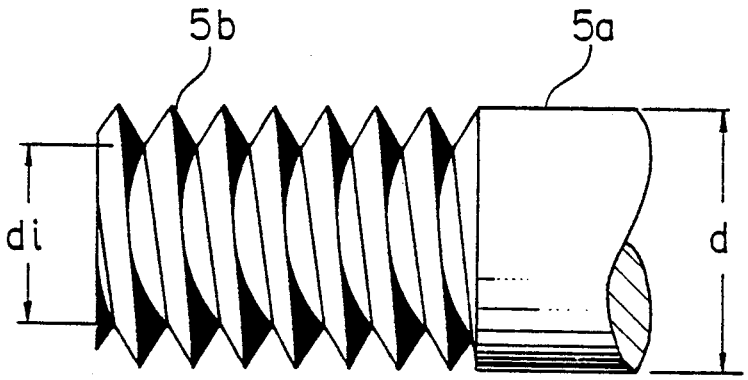
FIG. 5 (PRIOR ART)
FIG. 5 is a diagram of assistance in explaining the essential part of an anchor bolt of a conventional type.
Figure 12:
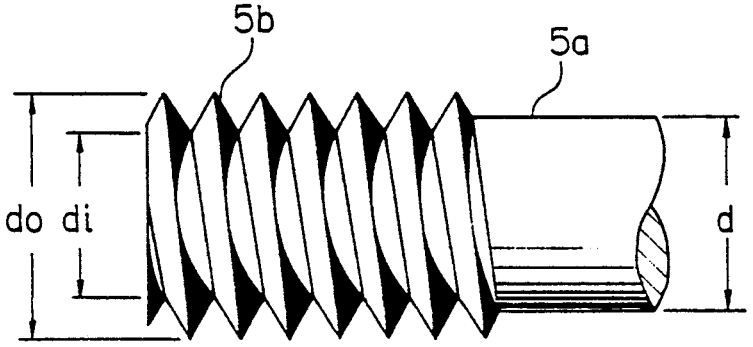
FIG. 12 is a diagram illustrating the essential part of an anchor bolt used in a third embodiment of this invention.

FIG. 12 is a diagram of assistance in explaining the essential part of an anchor bolt used in a third embodiment of this invention. Like parts are indicated by like numerals shown in FIG. 5. In FIG. 12, the threaded part **5*b* is formed by a thread rolling means. That is, when threaded parts 5*b* are rolled on both ends of the shank part 5*a* machined from a steel rod into an outside diameter d, the outside diameter $d_o$ of the threaded part 5*b* becomes larger than the outside diameter d of the shank part 5*a*, unlike the turning method. In the thread rolling method, the minor diameter $d_i$ of the threaded part 5*b* becomes approximately 95% of the outside diameter of the shank part 5*a*. Furthermore, the work-hardening associated with the thread rolling method increases the stress at the yield point of the threaded part 5*b* by approx. 13%. Consequently, assuming the stresses at the respective yield point of the shank part 5*a* and the threaded part 5*b*** are $\sigma a$ and $\sigma b$, the strength relationship is;

$$\frac{\pi}{4} di^2 \sigma b > \frac{\pi}{4} d^2 \sigma a$$

Figure 3:
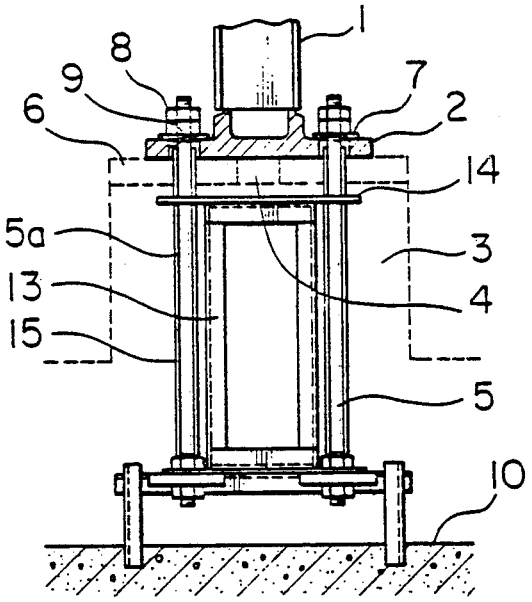
FIG. 3 (PRIOR ART)
FIG. 3 is a longitudinal section of the essential part of another example of a conventional column base structure.

For this reason, if the above construction employs anchor bolts 5 as shown in FIG. 3, the yield of the threaded part **5*b* shown in FIG. 12 does not precede that of the shank part 5*a*. From the above results, the entire extensional rigidity of the anchor bolt 5 when used in the embodiment shown in FIG. 3 can be evaluated to be an equal value to the Young's modulus of $2.1 \times 10^3$ t/cm$^2$ of the steel of which the anchor bolt 5** is made, that is, about twice as much the rotational rigidity of the conventional anchor bolts.

Figure 13:
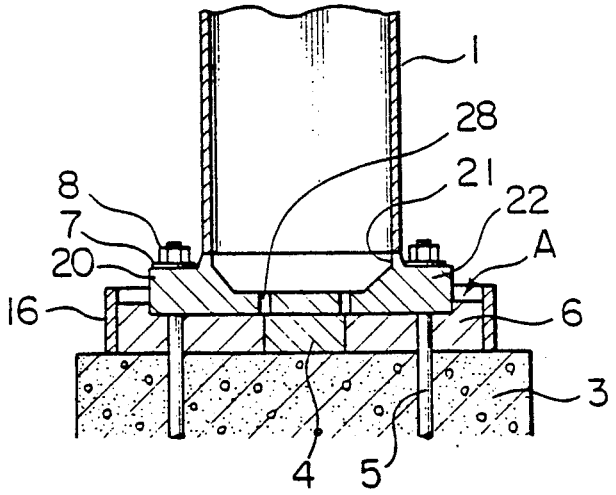
FIGS. 13 and 14 are a longitudinal section of the essential part and a partially cross-sectional plan view, respectively, of a fourth embodiment of this invention.
Figure 14:
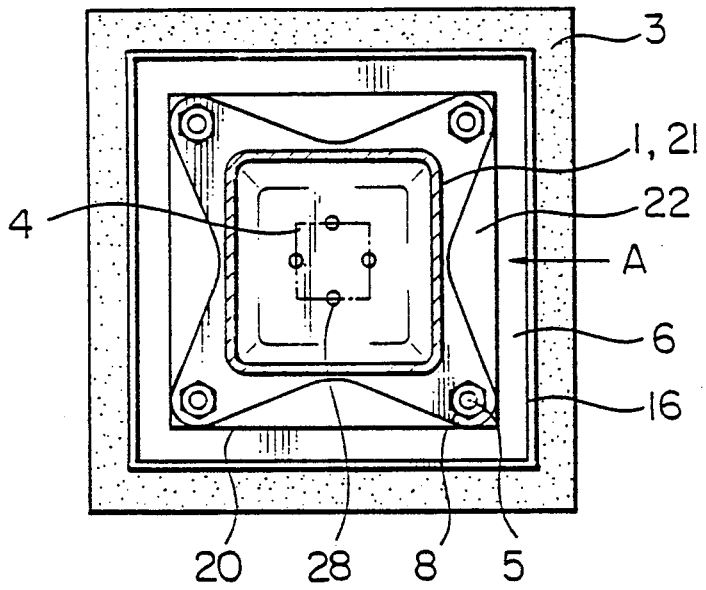

FIGS. 13 and 14 are a longitudinal section of the essential part and a partially cross-sectional plan view, respectively, of a fourth embodiment of this invention. Like parts are indicated by like numerals shown in FIGS. 1 and 2. In FIGS. 13 and 14, the column base metal fitting 20 is made of cast steel, for example, and having integrally formed a projection 21 having a flat surface corresponding to the contour of the lower end face of the steel-frame column 1 and a base plate 22 formed into a flat plate shape, and having drilled bolt holes (not shown) at locations corresponding to the anchor bolts 5. The plane contour of the projection 21 and the base plate 22 is formed into a square shape corresponding to the cross-sectional contour of the steel-frame column 1. Numeral 28 refers to a hole provided at a location almost corresponding to the plane contour of the partial mortar 4 in such a manner as to vertically passing through the column base metal fitting 20.

Figure 6:
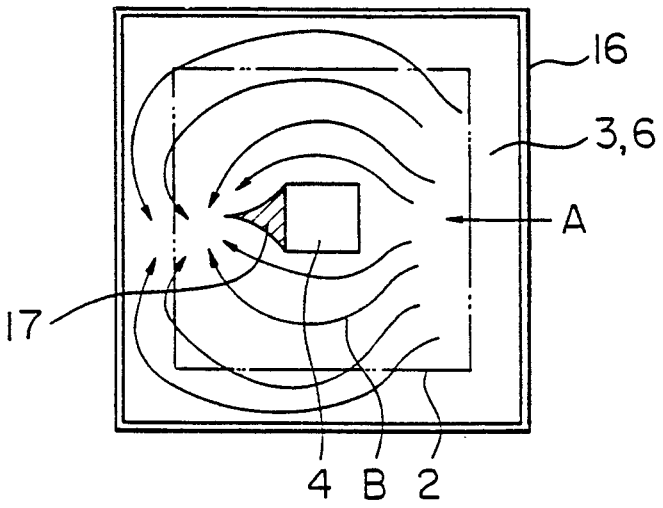
FIG. 6 (PRIOR ART)
FIG. 6 is a diagram of assistance in explaining the flow of mortar in a form.

With the above construction, the column base metal fitting 20 is welded together with the steel-frame column 1, and then positioned by placing on the partial mortar 4 provided in advance on the concrete foundation 3. Then, the mortar 6 is poured into the form 16 in the direction shown by arrow A. In this case, the mortar 6 flows as shown in FIG. 6 above and tends to entrap the air in the vicinity of the partial mortar 4. The presence of the hole 28 on the column base metal fitting 20, as shown in FIG. 13, allows the entrapped air to be easily discharged from the hole 28. Consequently, there is no obstacle to disturb the flow of the mortar 6, ensuring the complete adhesion of the mortar 6 to the bottom surface of the column base metal fitting 20, thus eliminating the formation of the cavity 17 as shown in FIG. 6.

Figure 15:
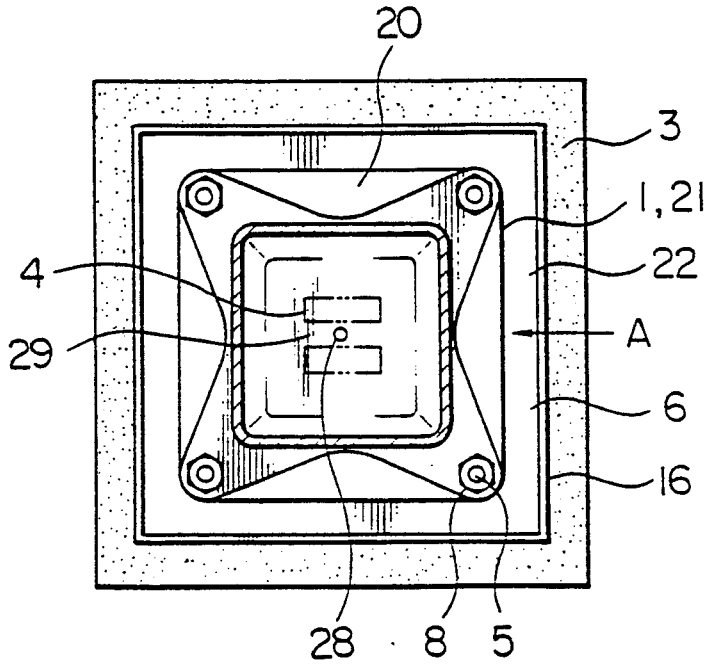
FIG. 15 is a partially cross-sectional plan view of a fifth embodiment of this invention.

FIG. 15 is a partially cross-sectional plan view of a fifth embodiment of this invention. Like parts are indicated by like numerals shown in FIGS. 13 and 14. In FIG. 15, numeral 29 refers to a groove provided in such a manner as to pass horizontally and in almost the same direction as the mortar pouring direction A. The hole 28 may be provided on the column base metal fitting 20 in the immediate vicinity of the groove 29.

With the above construction, as the mortar 6 is poured in the direction shown by arrow A, the mortar 6 flows in the same manner as described in the above embodiment and in the groove 29 provided on the partial mortar 4. The mortar flowing in the groove 29 moves in the groove 29 faster than the mortar flowing in the other parts, reaching near the edge of the column base metal fitting 20. This eliminates the entrapping of the air, ensuring the complete adhesion of the mortar to the bottom surface of the column base metal fitting 20. Even when the mortar 6 flows into the groove 29, entrapping the air, the presence of the hole 29 in the immediate vicinity of the groove 29 allows the air to be easily discharged.

Figure 16:
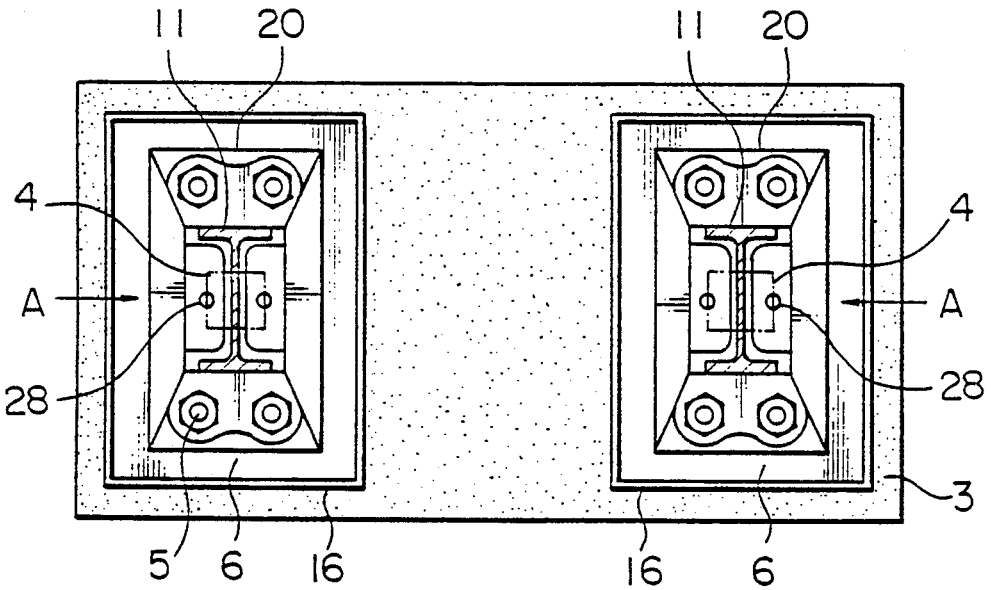
FIG. 16 is a partially cross-sectional plan view of a sixth embodiment of this invention.

FIG. 16 is a partially cross-sectional plan view of a sixth embodiment of this invention. Like parts are indicated by like numerals shown in FIGS. 13 through 15. In FIG. 16, the main column member 11 is made of H-section steel and welded to independent column base metal fittings 20 and 20 both of which are of the same dimensions. The horizontal and connecting members connecting the main column members 11 and 11 are omitted in the figure. Two holes 28 are provided on the column base metal fitting 20 at locations corresponding to the cross-sectional contour of the partial mortar 4 and almost in the middle of the flange part of the H-section steel constituting the main column member 11 and 11. This construction of the column base structure can be expected to be used widely in the industry because placing mortar 6 separately around the parts below each of the main column members 11 and 11 is more economical than placing mortar 6 at one location below the lower parts of both the main column members 11 and 11

Figure 17:
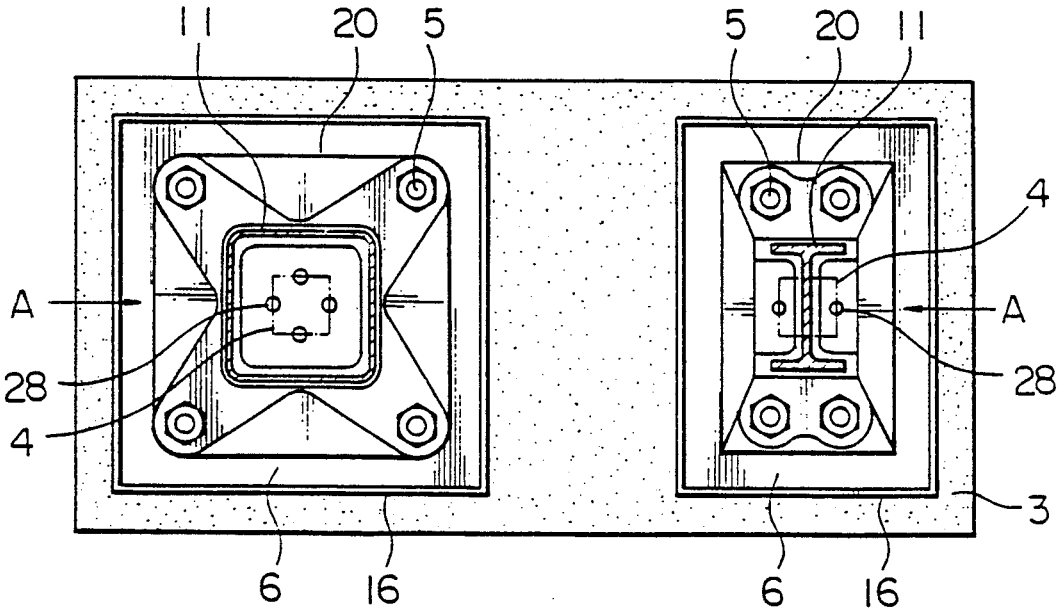
FIG. 17 is a partially cross-sectional plan view of a seventh embodiment of this invention.

FIG. 17 is a partially cross-sectional plan view of a seventh embodiment of this invention. Like parts are indicated by like numerals shown in FIG. 16. The embodiment shown in FIG. 17 is same as the sixth embodiment shown in FIG. 16, except that one of the main column members 11 and 11 is made of a square steel pipe and the other of H-section steel.

With the above construction, when mortar is poured in the direction shown by arrow A in FIGS. 16 and 17, the entrapped air can be easily discharged through the hole 28, as in the case of the fourth embodiment shown in FIGS. 13 and 14, thus ensuring the complete adhesion of the mortar 6 to the bottom surface of the column base metal fitting 20.

In the foregoing, description has been made on the embodiment in which the cross section of the main column member is formed into an H-shape, but the cross section of the main column member may be of a rectangular, square, circular or any other geometrical shape other than the H-shape. Similarly, the connecting member connecting the main column members may be made of shape steel, flat-rolled steel, or strip steel, other than steel pipe. Furthermore, the horizontal member may also be made of section steel, flat-rolled steel, strip steel or any other steel material that has a function of transmitting the shearing force in one main column member to the other main column member. The means for fabricating a column of an I or H cross-sectional shape may not be limited to the assembly of strip-shaped flange members and flat-sheet web members, but the flange member may be formed by section steel having a T or L cross section. And, the web member may have window-like holes in the middle part thereof. In short, the steel-frame column of this invention may be such that the cross-sectional outside dimensions of the column in the direction of the major axis intersecting orthogonally with the minor axis is made larger than the cross-sectional outside dimensions thereof in the the direction of the minor axis.

The above embodiments employ anchor bolts whose threaded parts are formed by the thread rolling method. The minor diameter of the threaded part, however, may be made larger than the outside diameter of the shank part. If such a threaded part is formed by a cutting means, the increase in the stress at the yield point resulting from work-hardening cannot be expected. But the extensional rigidity of the threaded part can be made equal to, or more than that of the shank part because the minimum cross-sectional area of the threaded part can be maintained at a value more than the cross-sectional area of the shank part. In the above embodiments, description has been made mainly on the behavior of the threaded part in the vicinity of the column base metal fitting, but the same effect can be expected with the threaded part embedded in the concrete foundation.

In the above embodiments, moreover, description has been made on the column base metal fitting which has an almost square planar shape. However, the same effect can be expected with the column base metal fitting having a quadrilateral shape, other than a square, or a circular or any other geometrical shape. The column base metal fitting may be made of steel plates or other steel materials, aside from cast steel. The holes provided on the column base metal fitting may be of other shapes than a circular shape and the number of holes may be selected freely. The number of the horizontal through-groove provided on the partial mortar may not be limited to one, but multiple through grooves may be provided. The planar shape of the partial mortar may be of a square, oval or any other shape, but if a horizontal through groove is not provided, the planar shape of the partial mortar should preferably include curves corresponding to the flow lines of the mortar.

This invention having the aforementioned construction and functions can achieve the following effects.

(1) The ease of the welding operations of the column base structure leads to reduced manhours and therefore lower manufacturing costs.

(2) Aseismic performance and reliability can be improved because the shearing force on the side to which a compressive force is applied can be positively transmitted to the side to which a tensile force is applied.

(3) With the construction in which the column base metal fitting is independently provided corresponding to the main column members or the flange members, the floor space for the column base metal fitting can be reduced, resulting in an increase in the building space.

(4) The rotational rigidity of the column base in the column base structure can be increased about twice as much as that of the conventional column base structure.

(5) Since the stress at the yield point of the entire anchor bolt comprising the column base structure can be increased, the energy absorbed by the column base in the event of an earthquake can be increased, and thus the aseismicity of the entire building can be improved substantially.

(6) With this invention, the air can be prevented from being entrapped when mortar is poured into the gap between the column base metal fitting and the concrete foundation. Therefore, the resulting cavity can be prevented perfectly. This ensures the complete adhesion of the mortar to the bottom surface of the column base metal fitting and substantially increases the aseismic performance required for the column base structure.

What is claimed is:

1. A column base structure comprising a column having a pair of main column members each of said main column members being formed by steel of H-section constituted by a pair of parallel flanges integrally joined by a web extending perpendicularly therebetween, the main column members being located spaced apart by a predetermined distance and in parallel relation with respective flanges of one column in coplanar relation with respective flanges of the other column and, connecting members disposed in such a manner as to integrally connect said main column members, and a pair of column base metal fittings joined to the lower part of said column in such a manner as to correspond to said main column members; said column base metal fittings being fixedly fitted to a concrete foundation via anchor bolts and nuts; in that a horizontal member formed by steel of H-section constituted by a pair of parallel flanges integrally joined by a web having the same width as the web of each of the main column members, said horizontal member, extending perpendicularly between said main column members and having the same width as the webs of the column members, is disposed in parallel with a floor surface, said horizontal member being fixedly fitted between said main column members in the vicinity of said column base metal fittings with the respective flanges and web of the horizontal member being connected at one end to the respective flanges and web of one column member and, at the other end, to respective flanges and web of the other column member so as to fill a rectangularly shaped area between the column members, and the following equation holds:

$$A \geqq 0.1 \frac{\sigma_{\gamma o}}{\sigma_{\gamma}} A_o$$

where $A_o$: cross-sectional area of a main column member

A: cross-sectional area of a horizontal member $\sigma_{\gamma o}$: yield point of a main column member $\sigma_{\gamma}$: yield point of a horizontal member.

2. A column base structure as set forth in claim (1) wherein an outside diameter of the threaded part of said anchor bolts is larger than an outside diameter of the shank part thereof.

3. A column base structure as set forth in claim (1) wherein projections formed into substantially the same cross-sectional shape as the cross-sectional shape of said main column members and adapted to be jointable to said main column members are integrally provided with said column base metal fittings; and at least one hole is formed through each of said column base metal fittings within the outside contour of said projections.

4. A column base structure comprising a column having a pair of identical H-section steel column members each constituted by a pair of parallel flanges integrally joined by a central web extending perpendicularly therebetween, the column members being connected together at intervals along their length so as to extend in spaced apart parallel relation with the central web aligned opposite and parallel to each other in vertical planes and the flanges of respective column members being in coplanar relation so as to define a rectangular area therebetween; column base metal fittings joined to lower ends of said steel column members; a concrete foundation; anchor bolt means anchoring the base metal fittings to the concrete foundation; and, an H-section steel bridging member having a pair of parallel flanges integrally joined by a central web extending perpendicularly therebetween, the bridging member extending horizontally between said steel column members with the central web and flanges thereof connected at respective opposite end to the central webs and flanges of the column members and the following equation holds:

$$A \geqq 0.1 \frac{\sigma_{\gamma o}}{\sigma_{\gamma}} A_o$$

where $A_o$: cross-sectional area of a main column member

A: cross-sectional area of a bridging member $\sigma_{\gamma o}$: yield point of a main column member $\sigma_{\gamma}$: yield point of a bridging member, whereby the bridging member fills the rectangular area between the central webs of said column members and transmits a shearing force generated in one column member to which a compressive force is applied to the other column member to which a tensile force is applied.

5. A column base structure as set forth in claim 4 wherein said anchor bolt means includes bolts having a threaded part extending axially from a shank part, the threaded part having an outside diameter larger than an outside diameter of the shank part.

* * * * *